US006667446B1

(12) United States Patent
Schuberth et al.

(10) Patent No.: US 6,667,446 B1
(45) Date of Patent: Dec. 23, 2003

(54) ROTARY KNOB DEVICE WITH A KEY FUNCTION

(75) Inventors: Stefan Schuberth, Bad Neustadt (DE); Reinhold Moret, Mellrichstadt (DE); Oliver Zegula, Bad Neustadt (DE)

(73) Assignee: Preh-Werke GmbH & Co. KG, Bad Neustadt/Saale (DE)

( * ) Notice: Subject to any disclaimer, the term of this patent is extended or adjusted under 35 U.S.C. 154(b) by 85 days.

(21) Appl. No.: 09/717,107

(22) Filed: Nov. 22, 2000

(30) Foreign Application Priority Data

Nov. 22, 1999 (DE) ..... 199 64 131

(51) Int. Cl.[7] ..... H01H 9/26
(52) U.S. Cl. ..... 200/4; 200/5 R
(58) Field of Search ..... 200/4, 5 R, 6 R, 200/11 R, 14, 7, 16 R, 17 R, 18, 336, 341, 345

(56) References Cited

U.S. PATENT DOCUMENTS 5,093,764 A 3/1992 Hasegawa et al.
5,373,142 A 12/1994 Ohshima et al.
5,959,267 A * 9/1999 Kawasaki et al. ..... 200/4
6,049,044 A * 4/2000 Mizobuchi ..... 200/4
6,236,002 B1 * 5/2001 Chou ..... 200/4
6,262,378 B1 * 7/2001 Chou ..... 200/4

FOREIGN PATENT DOCUMENTS

DE 0605324 A1 7/1994
DE 19633892 A1 2/1998
DE 19636643 11/1999
EP 0974843 A1 1/2000
WO WO 00/31765 A1 6/2000

* cited by examiner

*Primary Examiner*—Elvin Enad
*Assistant Examiner*—Lisa N Klaus
(74) *Attorney, Agent, or Firm*—Birch, Stewart, Kolasch & Birch, LLP

(57) ABSTRACT

A rotary knob device (1, 20) having a key function includes a key (5, 30) in a rotary knob (2, 23), which is operated separately from the rotary knob so that the key (5, 30) need not also be moved when the rotary knob (2, 23) is moved. In this regard, a holder (6, 24.1) is provided inside the rotary knob (2, 23), on which the rotary knob (2, 23) and the key (5, 30) are mounted to be thereby linked together structurally while functioning separately. The rotational control is transmitted by the rotary knob (2, 23), while key, linear movement, control is transmitted through the separate key (5, 30).

8 Claims, 3 Drawing Sheets

ROTARY KNOB DEVICE WITH A KEY FUNCTION

BACKGROUND OF THE INVENTION

This application claims a foreign priority date of German application 199 64 131.5, filed on Nov. 22, 1999, and the contents of that application is incorporated herein by reference.

This invention relates to a rotary knob device, or rotary switch, having a key function for manipulating control elements of a type including a hollow rotary knob which can be rotated to manipulate a first electrical control element and a key mounted in the rotary knob which can be linearly move within the rotary knob to manipulate a second electrical control element.

Rotary knob devices having a key function which are part of a rotary switch and/or a rotary controller are used in operating units, for example in automotive engineering.

Such a rotary knob is disclosed in German patent document 196 36 643 C1, where keying is performed at an end face of a top part of a rotary knob. The keying itself is performed centrally by additional switch mechanisms. When the rotary knob is rotated, the key is rotated as is a symbol on a top part of the key. This is a disadvantage, particularly when the symbol on the key should always remain horizontally in the same position. Another problem arises when central illumination of the function of the key is to be performed in addition to central contacting.

It is an object of this invention to provide a rotary knob device having a key in a rotary knob which remains horizontal even when the rotary knob is rotated. Another partial object is to provide a structure which allows a central illumination of the key along with central electrical contacting when keying.

SUMMARY OF THE INVENTION

According to principles of this invention, a rotary knob device having a key function includes a hollow rotary knob which can be rotated to manipulate a first electrical control element, a key mounted in the rotary knob which can be linearly move within the rotary knob to manipulate a second electrical control element and a holder which supports both the rotary knob and the key such that each can be moved on the holder separately from the other.

This invention is based on the idea of structuring a holder for supporting a rotary knob and a key in the rotary knob to be functionally separated from one another so that the key is not also rotated when the rotary knob is rotated. This holder is the structural connection between the rotary knob and the key. The rotational adjustment is transmitted through the rotary knob, while the key-function adjustment is carried out separately through the key. For central illumination and central contacting of the key at the same time, a flexible switch push member having a central bore is provided with electrical contacts mounted around it, preferably in a ring arrangement. Light needed for illumination can be introduced through the bore into the key.

Additional advantageous embodiments are also described.

Accordingly, a mating component of the rotary knob is movably mounted on the holder while the key is securely connected directly to the holder. The advantage here is that the key does not require additional alignment with a base plate or circuit board because the rotary switch can be designed as a compact individual part. A mounting of the rotary switch device in a panel may also be accomplished by the holder.

However, the holder may also be fixedly mounted on the mating component of the rotary knob in the rotary switch device or it may be part of the mating component.

The torque may be transmitted either directly or indirectly, with a variable-film potentiometer plate being mounted on the mating component of the rotary knob for direct transmission, while peripheral teeth are.provided on the mating component for an indirect transmission so that rotation is transmitted non-centrally to an electronic component.

Advantages of the proposed solution include, in addition to retaining the horizontal position of the key and the key symbol, the fact that a central homogeneous illumination of the key symbol and a central contacting beneath the key are accomplished independently of the rotational adjustment of the rotary knob of the rotary switch or the rotary control.

BRIEF DESCRIPTION OF THE DRAWINGS

Further benefits, characteristics and details of the invention are explained in more detail below using an embodiment shown in the drawings. The described and drawn features, can be used individually or in preferred combinations in other embodiments of the invention,. The foregoing and other objects, features and advantages of the invention will be apparent from the following more particular description of the preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DETAILED DESCRIPTION OF THE INVENTION

Figure 1:
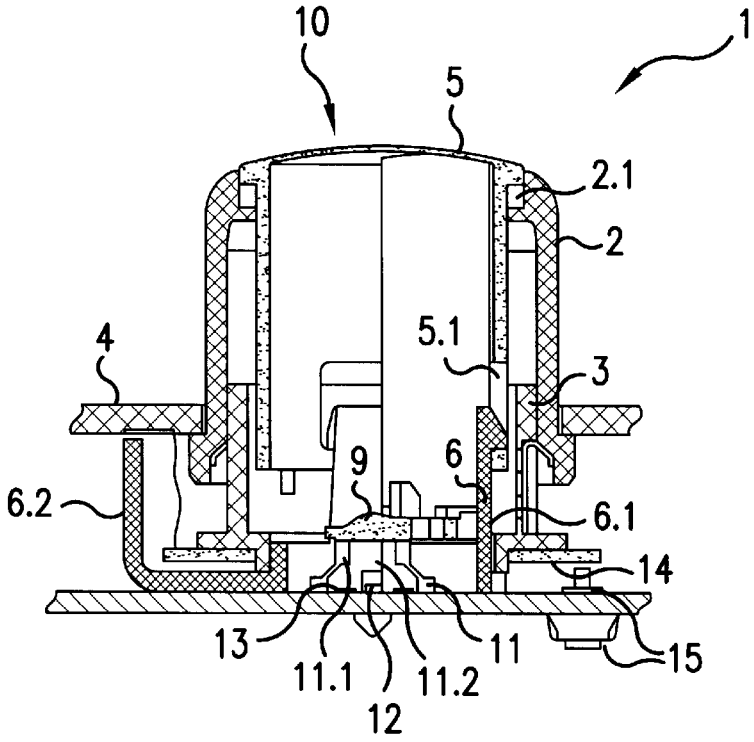
FIG. 1 is a side sectional view of a rotary switch having a key function of this invention.

FIG. 1 shows a rotary controller 1, in a structurally-compact form, including a hollow rotary knob 2 that cooperates with a rotary-knob substructure 3. This rotary controller 1 is mounted in a cover panel 4, for example a front panel of a motor vehicle dashboard. In addition, a key 5, which is mechanically held by a holder 6, is also integrated into the rotary knob 2. The rotary-knob substructure 3 is loosely positioned on the holder 6. The key 5 has perpendicular guide grooves 5.1 in which the holder 6 engages with its holding fingers 6.1, thus joining the key 5 to the holder 6 in a twist-proof manner. For uniform keying, three guide grooves 5.1 are preferably provided. A key path here is limited by a depression 2.1 in the rotary knob 2 and a length of the guide groove(s) 5.1.

The key 5 is preferably a hollow key element, so that holding fingers 6.1 engage inside the key. The key 5 also has an light guide 9, one end of which preferably extends inside the key 5 and projects into a head area of the key 5 to illuminate a key symbol 10.

In a preferred embodiment, when keying, the key 5 engages, via the light guide 9, a contact dome 11.1 of a switch push member 11 having a central bore 11.2 for light of a light element 12 such as an LED. Via this contact dome 11.1, contacts in the switch push member 11 and contacts of a circuit board 13 are centrally contacted.

For transmission of rotational information of the rotary switch 1 to an electronic component (not shown), the rotary-knob substructure 3 has a variable-film potentiometer plate 14 which contacts another contact element 15 of a circuit board 13. The holder 6 itself prevents the key 5 from turning when the rotary knob 2 is turned, but it does not prevent movement of the variable-film potentiometer plate 14 relative to the contact element 15, which thereby picks up different voltage values.

It is advantageous that the assembly of the individual elements is fixed in the panel 4 by the holder 6. The holder 6 preferably has there for two U-shaped catch elements 6.2 which project away from an intermediate space between two holding fingers 6.1, while leaving a free space to pick up the voltage value at contact element 15.

Figure 2:
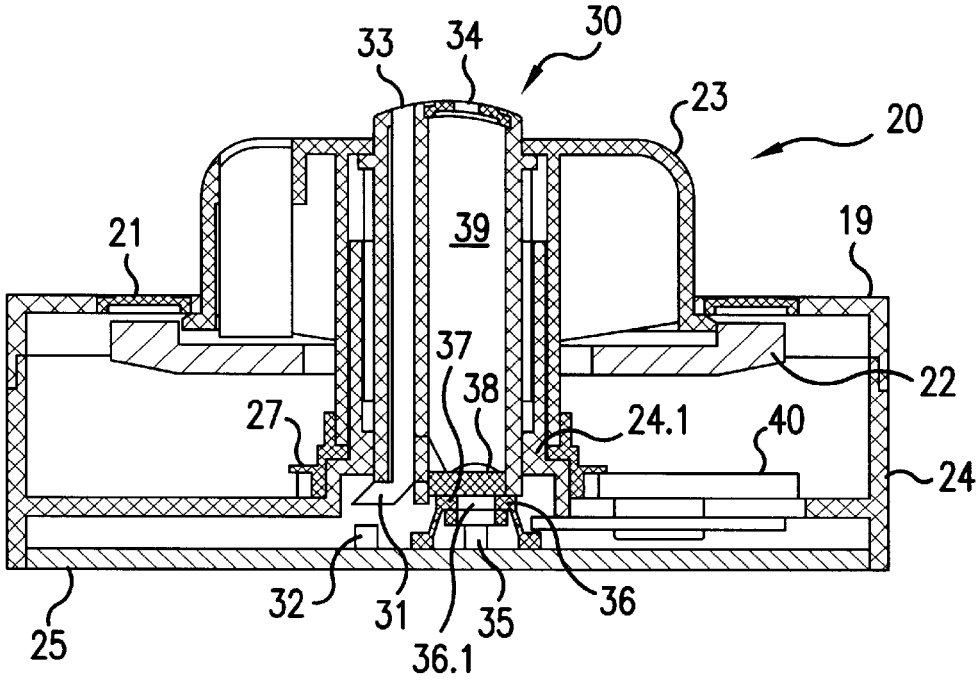
FIG. 2 is a side sectional view of a second embodiment rotary switch of this invention.
Figure 2A:
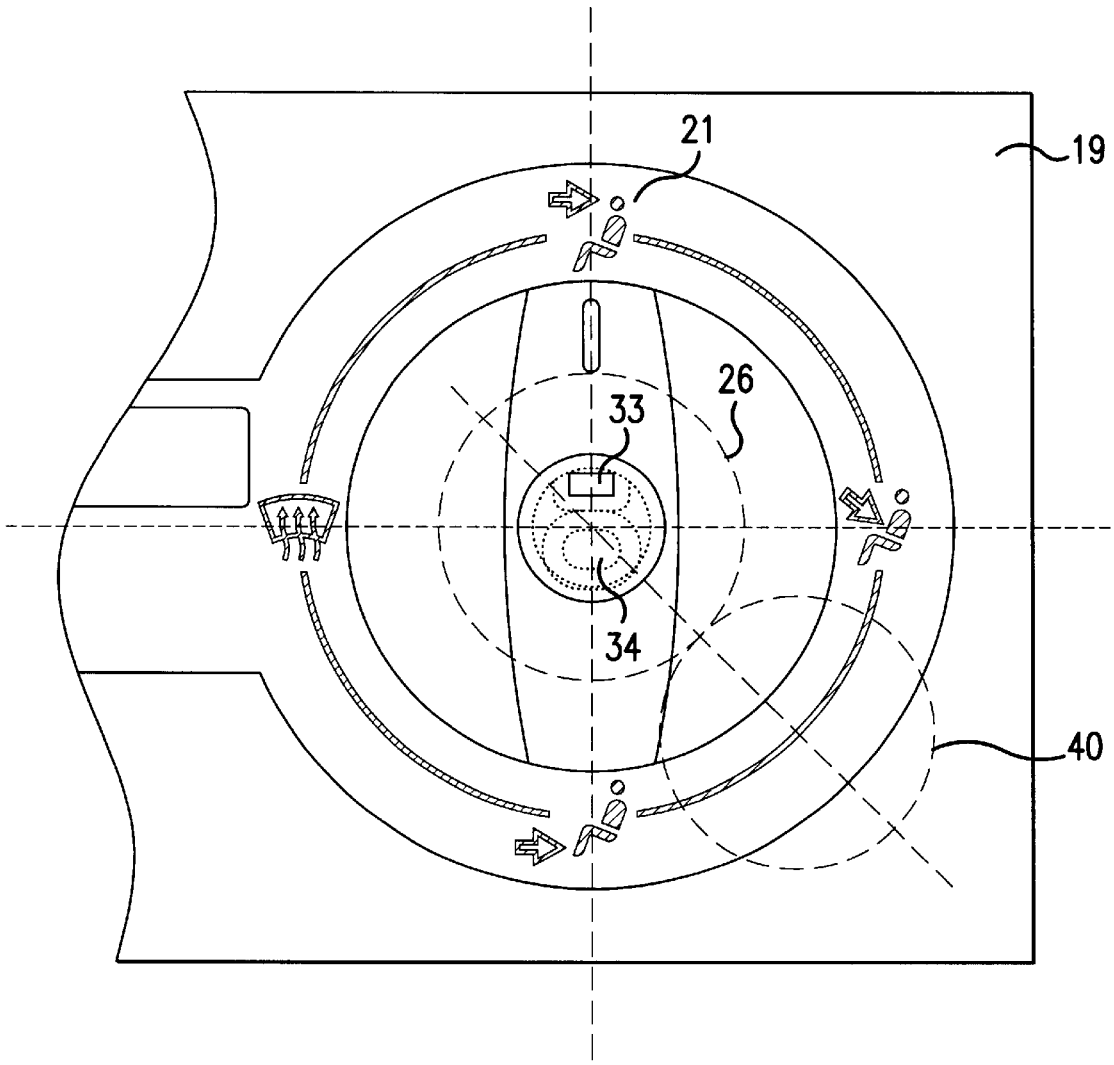
FIG. 2*a* is a top view of the rotary switch of FIG. 2.

FIG. 2 shows a rotary switch 20 having a key function. It can be integrated into a housing 24 as a mating piece for a hollow rotary knob 23 behind a cover panel 19 such as a front panel of an automotive operating unit (FIG. 2*a*). To illuminate the function symbol of the rotary switch 20, that is a symbol 21, a light panel 22 with activation is mounted beneath symbol(s) 21.

The rotary switch 20 has a key 30 in the rotary knob 23, which is mounted axially in the rotary knob 23 and in the housing 24 and which has a defined movement path with respect to the housing 24. The key 30 is guided by a holder 24.1 of the housing 24 during keying.

A light guide strip 31, for example, may be integrated into the key 30, through which light of an LED 32 of a circuit board 25 is guided to a function display 33 which displays a function of the key 30. A further symbol 34 serving as a function symbol of the key 30, for example "circulating air" (FIG. 2*a*), is provided in a top part of the key 30 and is illuminated by another LED 35 of the circuit board 25. Above the LED 35 there is a switch push member 36 having a central bore 36.1 with contacts arranged thereon, preferably in a circle. This switch push member 36 is provided with an additional lens system 38, preferably above the central bore 36.1. Through this lens system 38, light of the LED 35 passes through a hollow part 39 of the key 30 to the symbol 34.

Keying takes place aside from the rotary knob 23. In this regard, the key 30 with the light guide strip 31 and the hollow part 39 is moved in the direction of the circuit board 25, with the key 30, via the lens system 38, engaging a head part 37 of the switch push member 36, which yields to pressure. Beneath the switch push member 36, the contacts of the switch push member 36 come into contact with contacts of the circuit board 25. The light guide strip 31 is moved in the direction of LED 32 at the same time, resulting in better light coupling for the function display 33.

The rotary position of rotary knob 23 can be transmitted directly and centrally through a variable-film potentiometer plate (not shown in detail here) beneath rotary knob 23. The Holder 24.1 is structured so that the key 30 remains in its starting position when the rotary knob top part 23 is turned.

An indirect non-centered transmission of the rotary adjustment to an electronic component, for example, a potentiometer 40 of the rotary switch 20, is possible through gear teeth 26 on the rotary knob 23. However, this potentiometer 40 may also be adjusted during keying, to which end the rotary switch 20 has a pinion 27 which is moved during keying.

This type of gear teeth may also be mounted on the rotary knob 2 of rotary switch 1 (not shown in detail here), which would also result in an non-centered transmission of the rotational adjustment.

Figure 3:
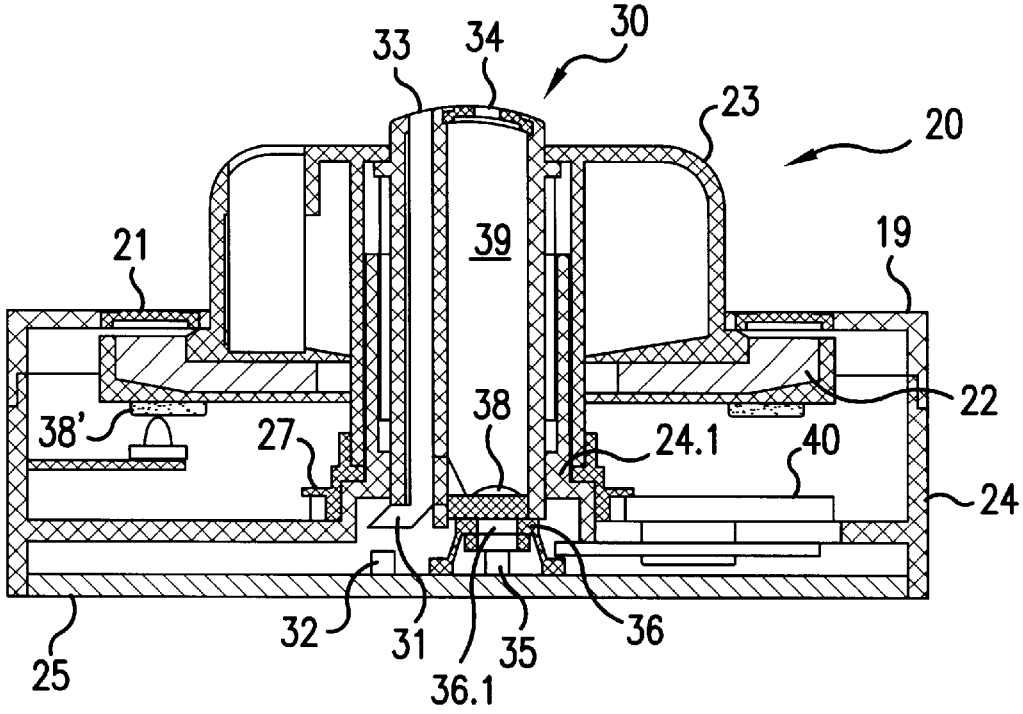
FIG. 3 is a side sectional view of a second embodiment rotary switch this invention.

In another embodiment (FIG. 3), based on related art, a variable-film potentiometer plate 38' is connected with the hollow rotary knob 23, for example a rotary resistor. The variable-film potentiometer plate 38 is preferably located beneath the light panel 22, which is preferably integrated into the rotary knob 23. Keying is accomplished as described above through the key 30, and illumination of the key symbol 10 is accomplished through the bore 36.1 of the switch push member 36.

Use of the rotary knob 2, 23 is not limited to automotive engineering. For example, the rotary knob 2, 23 may also be used in switch panels and control boards, etc.

What is claimed is:

1. A rotary knob device having a key function for manipulating control elements, wherein the rotary knob device includes a hollow rotary knob which can be rotated to manipulate a first control element, a key mounted in the rotary knob which can be linearly moved within the rotary knob to manipulate a second control element, wherein the rotary knob device further includes a holder which supports both the rotary knob and the key such that each can be moved separately on the holder from the other.

2. The rotary knob device of claim 1, wherein the second control element is an electrical switch push member having a central bore for permitting central illumination through a bore of a key symbol on the key while also allowing the second control element to make a central electrical contact beneath the key when the key is depressed.

3. The rotary knob device of claim 1, further including a rotary-knob substructure functioning as a mating component for the rotary knob which is mounted on the holder to allow rotation of the rotary knob about the holder, but with the holder having at least one holding finger for engaging directly in a guide groove of the key, so that the key is securely attached to the holder.

4. The rotary knob device of claim 1, wherein the holder is fixedly connected to a housing which functions as a mating component, while the key is movably guided on the holder.

5. The rotary knob device of claim 1, wherein a variable-film potentiometer plate is attached to the rotary knob.

6. The rotary knob device of claim 1, wherein teeth are provided around a periphery of the rotary knob for driving a non-centrally located potentiometer.

7. The rotary knob device according to claim 1, wherein the key remains in a starting position during operation of the rotary knob.

8. A rotary knob device having a key function for manipulating control elements, the rotary knob device comprising:

a hollow rotary knob which can be rotated to manipulate a first control element;

a key mounted in the rotary knob which can be linearly moved within the rotary knob to manipulate a second control element; and a holder, positioned between the rotary knob and the key, for supporting both the rotary knob and the key such that each can be moved on the holder separately from the other.

* * * * *